United States Patent [19]

Jordan et al.

[11] 4,046,123

[45] Sept. 6, 1977

[54] CONTACTLESS PHOTOELECTRIC IGNITION SYSTEM

[76] Inventors: Richard J. Jordan, 15821 Chestnut, Roseville, Mich. 48066; Charles W. Travis, 702 Satterlee, Bloomfield Hills, Mich. 48013

[21] Appl. No.: 653,368

[22] Filed: Jan. 29, 1976

[51] Int. Cl.[2] ..... F02P 1/00; F02B 3/00

[52] U.S. Cl. ..... 123/146.5 A; 123/148 E; 200/19 R; 250/233

[58] Field of Search ..... 123/148 E, 148 F, 148 CA, 123/148 CB, 148 CC, 146.5 A, 32 CA, 32 EJ; 200/27 A, 19 R, 19 M; 250/233

[56] References Cited

U.S. PATENT DOCUMENTS

| | | | |
|---|---|---|---|
| 3,463,134 | 8/1969 | Zechnall et al. | 123/146.5 A |
| 3,788,285 | 1/1974 | Gelin et al. | 123/32 CA |

*Primary Examiner*—Carroll B. Dority, Jr.
*Assistant Examiner*—Ronald B. Cox
*Attorney, Agent, or Firm*—Hauke and Patalidis

[57] ABSTRACT

A contactless ignition system for internal combustion engines permitting the elimination of mechanical ignition points by replacing such ignition points by a radiation source and a radiation sensitive element mounted on the distributor breaker plate. The radiation source, such as a light emitting diode, emits a radiation beam, such as a light beam, impinging upon the cam portion of the distributor shaft and which is reflected onto the radiation sensitive element, such as a photoelectric cell, or photoresistor or photoconductor, for example, or preferably a phototransistor providing at its output an appropriate timing pulse for a given angular position of the distributor shaft.

16 Claims, 6 Drawing Figures

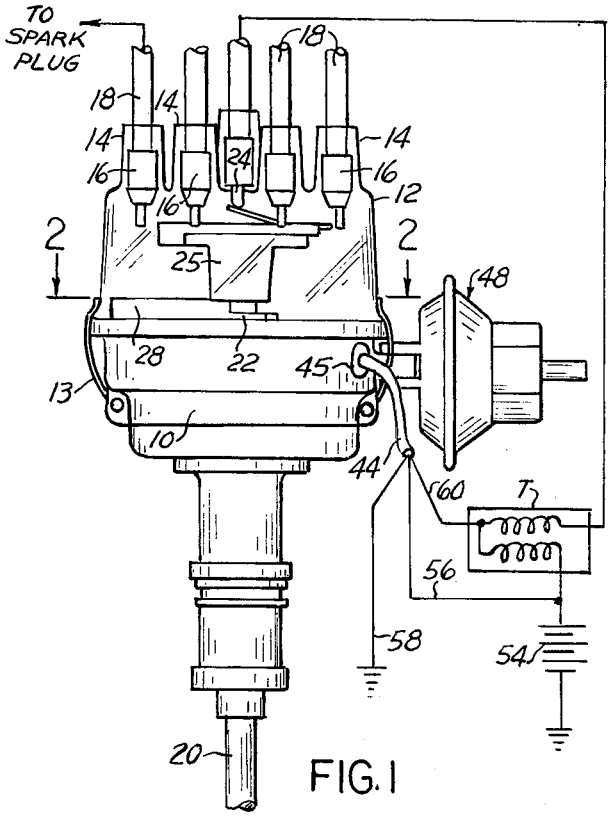
FIG. 1
FIG. 3
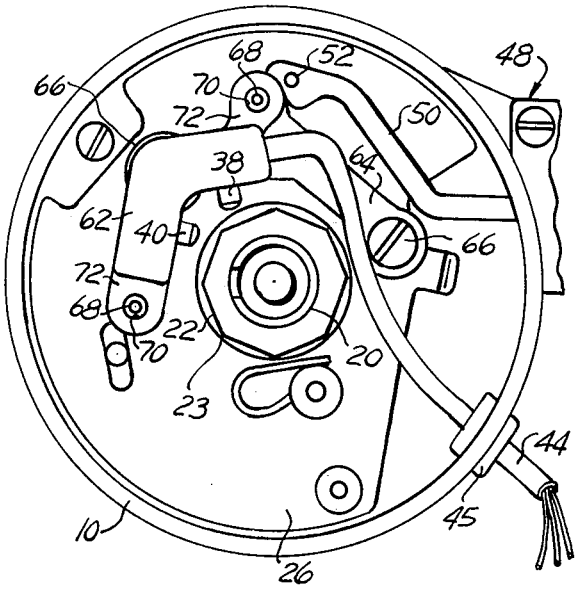
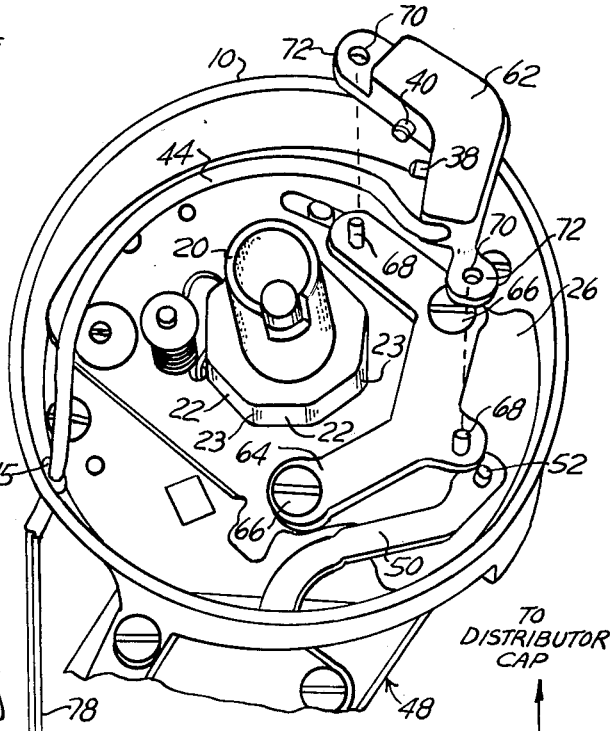
FIG. 4
FIG. 2
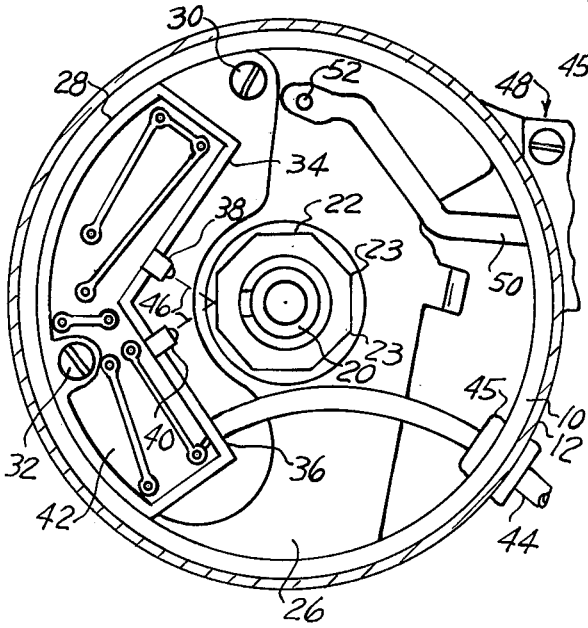

CONTACTLESS PHOTOELECTRIC IGNITION SYSTEM

BACKGROUND OF THE INVENTION

The present invention relates in general to ignition systems for internal combustion engines and more particularly to contactless ignition systems providing a direct replacement for mechanical ignition points.

The mechanical ignition points used in conventional ignition distributors for internal combustion engines are of limited reliability. Their limited reliability is due to pitting and burning of the contact points and wear of the contact point lifter in engagement with the cams on the end of the distributor shaft. The points must be checked at regular intervals and the gap reset when necessary. The contact surfaces require refacing or cleaning at regular intervals, and the points must be replaced when excessively pitted or worn. Failure of the capacitor normally connected in parallel across the contact points, such as shorting causes complete ignition failure. Cut-off of the capacitor or defective grounding causes excessive sparking at the points, resulting in pitting, burning and rapid deterioration of the point contact surfaces. Non-conductive, or poorly conductive, dirt between the point contact surfaces causes complete failure of the ignition system.

Another disadvantage associated with conventional mechanical ignition points which causes malfunction at high RPM of the internal combustion engine is due to the rebound or floating of the points caused by inertia and deflection of the elements when the movable breaker points are rapidly oscillated by the rapidly rotating cam of the distributor shaft.

Attempts have been made in the past to remedy some of the disadvantages associated with conventional mechanical ignition points for automotive ignition distributors, such as using electromagnetic pickups, as disclosed in U.S. Pat. No. 3,787,432, or replacing the mechanical ignition points with a photoelectric system comprising in combination a light source, a photoelectric pickup element and a rotatable shutter in the form of a slotted disk or drum placed between the light source and the photoelectric pickup element, as disclosed for example in U.S. Pat. Nos. 3,792,261, 3,621,826, 3,421,488, 3,422,804, 3,235,742, 3,386,000 and 2,084,267. However, the latter arrangements require the designing of an entirely new ignition distributor with appropriate means for driving the slotted disk or drum. Electromagnetic pickup devices have poor reliability and do not provide accurate timing of the ignition pulses.

The present invention, by contrast, permits to provide a low cost direct replacement for conventional mechanical ignition points for engines already equipped with conventional ignition systems. The present invention requires no modification to the conventional ignition systems and it provides a simple standard unit adapted for mounting, through an adapter plate, on the distributor breaker plate instead of the mechanical points and capacitor, without any other modification or adaptation of the distributor such that the conventional ignition advance mechanism, the distributor rotor and cam and the distributor cap are utilized as parts of the ignition system. Furthermore, the present invention is useful in solid state or electronic ignition systems, and may be used in combination with the high frequency ignition system disclosed and claimed in U.S. Pat. No. 3,900,786.

SUMMARY OF THE PRESENT INVENTION

According to the present invention, a contactless ignition system is provided by replacing the mechanical ignition points of a distributor for internal combustion engines by a radiation source and a radiation sensitive element, such as a light emitting diode and a phototransistor, respectively, which are mounted on the distributor breaker plate proximate the cam normally provided on the end of the distributor shaft, such that the light reflected on the surface of each cam portion at a given angular position of the cam impinges on the radiation sensitive element for appropriate and accurate timing of an ignition pulse.

The many objects, features and advantages of the present invention will become apparent to those skilled in the art when the following description of the best mode contemplated for practicing the invention is read in conjunction with the accompanying drawing in which:

BRIEF DESCRIPTION OF THE DRAWING

FIG. 1 illustrates a side elevation view of a distributor for internal combustion engines incorporating the present invention, with some portions of the ignition circuit being shown in a schematic manner;

FIG. 2 is a top plan view, substantially along line 2—2 of FIG. 1, with the rotor normally mounted on the end of the distributor shaft being removed for the sake of clarity;

FIG. 3 is a view similar to FIG. 2 but showing a modification of the present invention;

FIG. 4 is a perspective exploded view of the arrangement of FIG. 3 further illustrating the remainder of the ignition system in a schematic form;

DETAILED DESCRIPTION OF THE PREFERRED EMBODIMENTS

Figure 6:
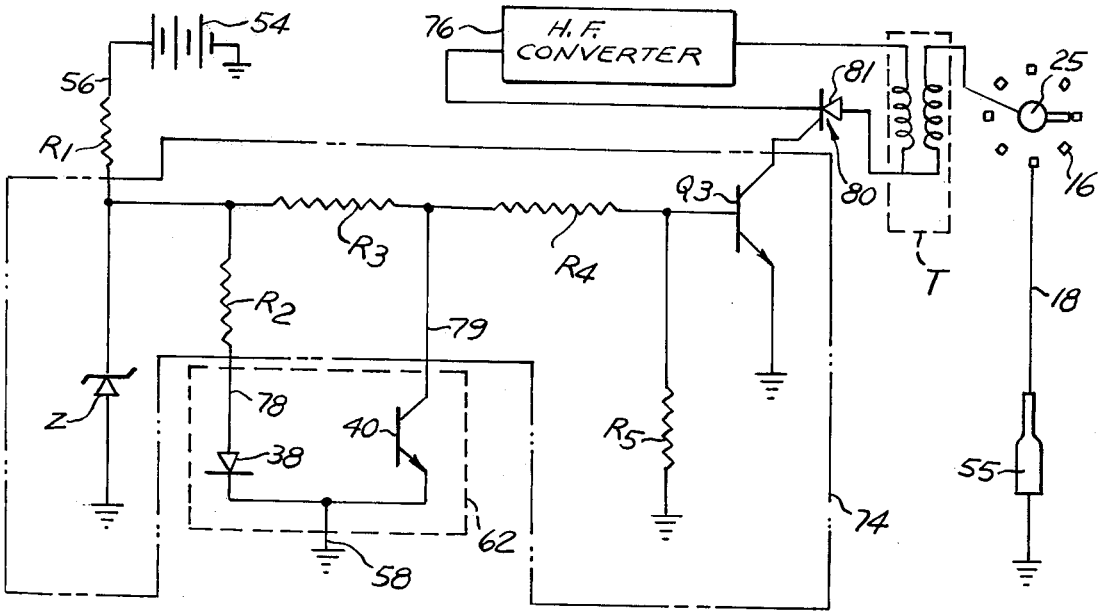
FIG. 6 is a schematic circuit diagram of the arrangement of FIGS. 3 and 4.

Referring now to FIG. 1, there is illustrated a distributor for an internal combustion engine comprising a housing 10 provided with a removable cover 12 normally held in position by means of spring clips 13. The cover 12 is normally molded of a dielectric material which is shown as being a transparent material, which in fact may be the case, for the convenience of showing some of the elements disposed internally. At the upper surface of the cover 12 a plurality of bosses, as shown at 14, are molded about a circle such as to provide each an individual integral housing for a terminal 16 of an ignition wire 18 connected to a spark plug of the internal combustion engine, not shown.

A rotatable shaft 20, normally driven from the crankshaft or camshaft of the internal combustion engine, is journalled in the housing 10 and is provided at its upper end with a plurality of cam surfaces 22 which, as best shown at FIG. 2, are eight in number for operation in conjunction with an eight-cylinder internal combustion engine. In conventional distributors, the edges 23 between consecutive cam surfaces 22 open the normally closed mechanical ignition points, so as to open a normally closed circuit through the primary of an ignition coil, with the result that a high voltage pulse is provided across the secondary of the ignition coil for distribution to an appropriate spark plug by being supplied to the center terminal 24 of the distributor cap 12 and supplied to the appropriate spark plug wire 18 by means of a rotating contactor, or rotor 25 mounted on the end of the shaft 20, as is well known in the art.

According to the present invention, however, and as best shown at FIG. 2, the conventional mechanical ignition points normally mounted in the housing 10 on a breaker plate 26 are replaced by a molding 28 made preferably of a plastic material fastened on the surface of the breaker plate 26 by any convenient means such as screws 30 and 32. The molding 28 has a pair of mutualy angularly disposed sidewalls 34 and 36 arranged to face the cam end portion of the shaft 20 projecting through the breaker plate 26. One of the molding sidewalls, sidewall 34, for example, supports a radiation source such as a light emitting diode (LED) 38, the other sidewall, sidewall 36 in this instance, supporting a radiation sensitive element such as a photocell, photoresistor or photoconductor, preferably a phototransistor 40. A printed circuit 42 fastened in the housing 28 provides appropriate electrical connections between diverse components mounted thereon and between such components and the light emitting diode 38 and the phototransistor 40. A cable 44 passed through a grommeted hole 45 in the wall of the distributor housing 10, provides connections to a power supply and to a utilization circuit, as schematically illustrated at FIG. 1 and as explained in further detail hereinafter.

It is readily apparent that when a cam surface 22 at the end of the shaft 20 is rotated relative to the housing 10, for a given angular position of the distributor shaft 20 the light beam, illustrated at 46 at FIG. 2, emitted by the LED 38 is reflected by the cam surface 22 and is caused to impinge upon the phototransistor 40. This "specular reflection" of the light beam 46 emitted by the LED 38 occurs at a well-determined angular position of the distributor shaft 20, namely when a cam surface 22 is angularly positioned such that a line perpendicular to the cam surface bisects the angle formed by the optical axes of the LED 38 and of the phototransistor 40. No light beam impinges upon the phototransistor 40 for any other angular position of each of the cam surfaces 22 on the end of the shaft 20. There results a very precise timing of the moment at which the phototransistor 40 "sees" the light beam 46, and the phototransistor 40 sees the light beam eight times in the course of a single revolution of the shaft 20 in the example illustrated, each time a cam surface 22 is in an appropriate and precisely defined position.

The distributor is provided, in a conventional manner, with an advance system such as the vacuum advance mechanism 48 which, as best shown at FIG. 2, includes a central arm 50 connected by means such as a pivot pin 52 to the breaker plate 26, the breaker plate 26 being angularly positionable relative to the housing 10 about the axis of the shaft 20 to provide appropriate advance or delay of the ignition timing, in the usual well-known manner.

Figure 5:
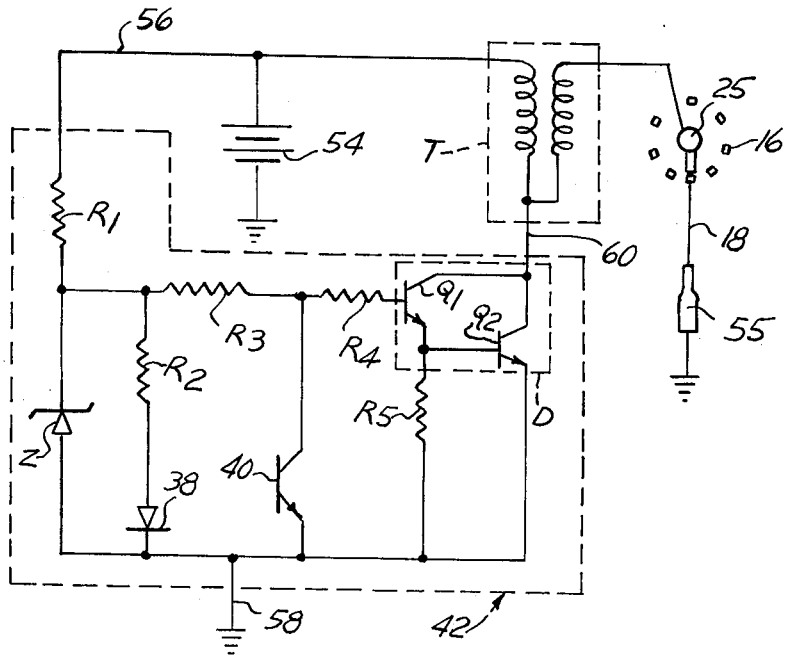
FIG. 5 is a schematic circuit diagram of the arrangement of FIGS. 1 and 2.

As shown at FIGS. 1 and 2 and in more detail at FIG. 5, a source of direct current or battery 54, which normally is the battery generally associated with a motor vehicle, supplies electric power to the LED 38 and to the phototransistor 40, the arrangement of the elements being as illustrated at FIG. 5. Electric power from the battery 54 is supplied via a line 56 to the elements of the printed circuit 42 through a current limiting and voltage dropping resistor $R_1$, the voltage across the circuit being regulated by way of a zener diode Z. The voltage across the zener diode Z is applied through a limiting resistor $R_2$ across the LED 38 and through a biasing resistor $R_3$ across the phototransistor 40. The emitter-collector circuit of the phototransistor 40 is connected through a load resistor $R_4$ to the input of a Darlington circuit D, consisting of a pair of transistors $Q_1$ and $Q_2$, connected as shown, acting as a switch normally biased to conductance by a resistor $R_5$. The Darlington circuit D is in series in the primary circuit of a conventionl ignition coil T, the secondary of which is connected to the rotor 25 mounted on the end of the distributor shaft. The rotation of the distributor shaft causes the rotor 25 to alternately connect each one of a plurality of spark plugs 55, in a well-known manner across the secondary of the ignition coil T.

Rotation of the distributor shaft 20, FIGS. 1 and 2, causes the light beam 46 emitted by the LED 38, after reflection on a cam surface 22 to impinge upon the phototransistor 40 at a precise angular position of the cam surface. The phototransistor 40 becomes conductive and shunts the Darlington circuit D, such as to cause the Darlington circuit to be turned off. Current ceases to flow through the primary of the coil T, therefore inducing a high voltage pulse to appear across the secondary to supply a sparking voltage to an appropriate spark plug 55 as determined by the angular position of the rotor 25 presenting its end contact in a spark gap position relative to one of the spark plug terminals 16.

The molding 28 and the elements mounted thereon therefore take the place of the mechanical points and capacitor normally mounted on the distributor breaker plate 26. The cable 44, projecting from the distributor housing 10 includes three wires with appropriate terminals, one such wire as shown at 56 at FIGS. 1 and 5 being for connection to the positive terminal, for example, of a battery 54, the second wire identified at 58 being for connection to ground and the third wire identified at 60 being for connection to the terminal of the ignition coil T.

The modification illustrated at FIGS. 3-4 represents a direct replacement for conventional mechanical distributor points. The LED 38 and the phototransistor 40 are mounted on the sidewalls of a generally L-shaped molding 62 which in turn is mounted on an adapter plate 64 made of plastic or like material which is fastened by means of mounting screws 66 on the breaker plate 26. The adapter plate 64 is designed to be fastened on the breaker plate 26 by means of screws 66 inserted in the threaded mounting holes for the conventional mechanical points which the present invention replaces. For that purpose, the adapter plate 64 is designed such that its mounting holes fit the mechanical points mounting holes for a particular type and make of distributor, while the molding 62 is designed as a standard component which can be mounted on the breaker plate of any make or model of distributor by way of an appropriate intermediary adapter plate 64. The adapter plate 64 is provided with a pair of upwardly projecting expandable pins 68 insertable in mounting holes 70 formed on integral mounting brackets 72 projecting on either end of the molding 62.

A cable conduit 44 passing through grommeted hole 45 in the wall of the distributor housing 10 includes three wires for connection to a circuit 74 which comprises, as best shown at FIG. 6, all the components associated with the LED 38 and the phototransistor 40. It will be readily apparent that, if so desired, such components may be on a circuit or a chip mounted in the molding 62, the remaining of the ignition system being the same as illustrated at FIGS. 1-2 and 5 and hereinbefore described. However, the contactless ignition system of the invention is particularly convenient for combination with the high frequency generator disclosed in U.S. Pat. No. 3,900,786, in which case the circuit 74 may be made a part of the high frequency generator 76 such that, as illustrated at FIGS. 4 and 6, the cable conduit 44 contains three wires for connecting to the element consisting of the combined circuit 74 and the high frequency generator 76. One of such wires, such as wire 58 is a grounding wire, while the other wires 78 and 79 respectively provide appropriate connections to the LED 38 and to the phototransistor 40 from the circuit 74, as best shown at FIG. 6 The high frequency generator 76, as disclosed in detail in the aforesaid referred to Letters Patent, is preferably a high voltage pulse generating circuit of the capacitor discharge type, having an output which may be switched on and off directly into the common terminal of the distributor rotor or, alternatively, and as illustrated, into the primary of the ignition coil T. Each time the output of the high frequency generator 76 is connected to the ignition coil T by way of a controllable switching means 80, a high frequency high voltage pulse train is supplied at the appropriate spark plug as determined by the position of the distributor rotor 25, FIG. 6. Preferably, the switching means 80 consists of an SCR 81 placed in series between the output of the high frequency generator 76 and the primary of the ignition coil T, the control gate of the SCR 81 being connected to the collector of the transistor $Q_1$, as illustrated in the circuit diagram of FIG. 6. Otherwise, the circuits of FIGS. 5 and FIG. 6 are the same.

An example of elements for practical application of the present invention is as follows, reference being had to the schematics of FIGS. 5 and 6:

| | |
|---|---|
| zener diode Z | 1N4736 |
| LED 38 | 55L5B |
| phototransistor 40 | L14G1 |
| Darlington D | U2T601 |
| resistor $R_1$ | 100 ohms |
| resistor $R_2$ | 180 ohms |
| resistor $R_3$ | 12K ohms |
| resistor $R_4$ | 4.7 ohms |
| resistor $R_5$ | 4.7 ohms |

Although the description of the present invention has been given with reference to particular embodiments, such embodiments are not to be construed in a limiting sense. Many variations or modifications will be apparent to those skilled in the art, without departing from the scope of the invention as recited in the appended claims.

What is claimed as new is:

1. In combination with an internal combustion engine distributor having a rotatable cam shaft and a breaker plate, a radiation source, a radiation sensitive element, means for mounting said radiation source and said radiation sensitive element on said breaker plate such that the radiation emitted by said radiation source impinging on said cam shaft is reflected onto said radiation sensitive element at a predetermined angular position of said cam shaft and means for connecting said radiation sensitive element to a utilization circuit.

2. The combination of claim 1 wherein said radiation source is a light emitting diode.

3. The combination of claim 1 wherein said radiation sensitive element is a phototransistor.

4. The combination of claim 1 wherein said radiation source and said radiation sensitive element are mounted on a common support mounted on said breaker plate suchas to replace the breaker points of said distributor.

5. The combination of claim 1 wherein said utilization circuit comprises switching means controllable by said radiation sensitive element connected in series in the primary circuit of an ignition coil.

6. The combination of claim 1 wherein said utilization circuit comprises switching means controllable by said radiation sensitive element for placing the output of a frequency generator in the primary circuit of an ignition coil.

7. The combination of claim 2 wherein said radiation sensitive element is a phototransistor.

8. The combination of claim 4 wherein said utilization circuit comprises switching means controllable by said radiation sensitive element connected in series in the primary circuit of an ignition coil.

9. The combination of claim 4 wherein said utilization circuit comprises switching means controllable by said radiation sensitive element for placing the output of a frequency generator in the primary circuit of an ignition coil.

10. The combination of claim 4 wherein said common support is mounted on said breaker plate by way of an intermediary adapter plate.

11. The combination of claim 7 wherein said utilization circuit comprises switching means controllable by said radiation sensitive element connected in series in the primary circuit of an ignition coil.

12. The combination of claim 11 wherein said utilization circuit comprises switching means controllable by said radiation sensitive element connected in series in the primary circuit of an ignition coil.

13. The combination of claim 11 wherein said utilization circuit comprises switching means controllable by said radiation sensitive element for placing the output of a frequency generator in the primary circuit of an ignition coil.

14. The combination of claim 11 wherein said common support is mounted on said breaker plate by way of an intermediary adapter plate.

15. The combination of claim 14 wherein said utilization circuit comprises switching means controllable by said radiation sensitive element connected in series in the primary of an ignition coil.

16. The combination of claim 14 wherein said utilization circuit comprises switching means controllable by said radiation sensitive element for placing the output of a frequency generator in the primary circuit of an ignition coil.

* * * * *